US011751613B1

(12) United States Patent
Sartelli

(10) Patent No.: US 11,751,613 B1
(45) Date of Patent: Sep. 12, 2023

(54) BODY COOLING SCARF

(71) Applicant: Desiderio Sartelli, Miami Beach, FL (US)

(72) Inventor: Desiderio Sartelli, Miami Beach, FL (US)

( * ) Notice: Subject to any disclaimer, the term of this patent is extended or adjusted under 35 U.S.C. 154(b) by 0 days.

(21) Appl. No.: 16/873,523

(22) Filed: Apr. 27, 2020

(51) Int. Cl.
*A41D 13/005* (2006.01)
*A41D 23/00* (2006.01)

(52) U.S. Cl.
CPC ..... *A41D 13/0058* (2013.01); *A41D 23/00* (2013.01)

(58) Field of Classification Search
CPC ..... A41D 13/0058; A41D 13/0055; A61F 2007/0233; A61F 2007/0238; A41D 2023/002; A41D 23/00; A41D 2023/004
USPC ..... 2/207
See application file for complete search history.

(56) References Cited

U.S. PATENT DOCUMENTS 1,365,526 A * 1/1921 Milkes ..... A41D 27/10 2/270
2,562,121 A * 7/1951 Poux ..... A61F 7/02 165/46
3,111,676 A * 11/1963 Artzt et al. ..... A41B 13/00 2/80
3,381,311 A * 5/1968 Wormser ..... A41D 10/00 2/270
3,476,102 A * 11/1969 Sarnoff ..... A41D 13/0055 126/204
3,802,215 A * 4/1974 Rowe ..... F25D 3/14 62/259.3
3,889,684 A * 6/1975 Lebold ..... A61F 7/02 607/109
3,950,789 A * 4/1976 Konz et al. ..... A41D 13/0055 2/93
4,204,543 A * 5/1980 Henderson ..... A41D 13/0055 607/112
4,326,533 A * 4/1982 Henderson ..... F25D 3/08 2/171.2
4,475,253 A * 10/1984 Laveckis ..... A41D 27/00 2/232
4,527,566 A * 7/1985 Abare ..... A61F 7/02 601/15
4,576,169 A * 3/1986 Williams ..... A61F 7/10 607/109

(Continued)

*Primary Examiner* — Alissa L Hoey
(74) *Attorney, Agent, or Firm* — Frank L. Kubler

(57) ABSTRACT

A body cooling scarf includes a flexible tube having a tube side wall and a tube open end and a tube closed end, defining within the flexible tube an elongate tube internal chamber; a flexible, chamber partition extending longitudinally within and dividing the tube internal chamber into a longitudinal first cooling unit pocket and a second cooling unit pocket, each having a pocket interior with a pocket interior width, breadth and length; and a series of cooling units which are sized in width and breadth to substantially match the width and breadth of each cooling unit pocket interior, and sized in length so that a series of between six and fourteen cooling units are required to completely fill a given pocket, for substantial cooling scarf flexibility.

12 Claims, 4 Drawing Sheets

(56) References Cited

U.S. PATENT DOCUMENTS 4,641,655 A * 2/1987 Abt ..... A61F 7/10 383/901
4,676,247 A * 6/1987 Van Cleve ..... A61F 7/02 607/112
4,805,619 A * 2/1989 Swearingen ..... A61F 7/103 383/901
5,005,374 A * 4/1991 Spitler ..... A41D 13/0055 2/171.2
5,067,179 A * 11/1991 Wormser ..... A41D 15/00 2/269
5,072,598 A * 12/1991 Dibrell ..... F25D 3/08 62/259.3
5,111,810 A * 5/1992 Fortney ..... A61F 7/02 602/2
5,211,623 A * 5/1993 Sarkozi ..... A61F 5/055
5,247,928 A * 9/1993 Stilts, Jr. ..... A61F 7/03 607/109
5,265,669 A * 11/1993 Schneider ..... A61F 7/02 165/46
5,302,806 A * 4/1994 Simmons et al. .. A41D 13/0051 219/211
5,305,470 A * 4/1994 McKay ..... A41D 20/005 2/170
5,305,471 A * 4/1994 Steele et al. ..... A41D 13/0058 2/102
5,327,585 A * 7/1994 Karlan ..... A42B 1/008 2/171.2
5,415,222 A * 5/1995 Colvin et al. ..... F28D 20/02 165/46
5,415,624 A * 5/1995 Williams ..... A61F 5/0104 602/14
5,484,448 A * 1/1996 Steele et al. ..... A41D 13/0053 607/108
5,524,293 A * 6/1996 Kung ..... A41D 13/0053 2/102
5,572,745 A * 11/1996 Mainus ..... A61F 9/045 2/171.2
5,618,263 A * 4/1997 Alivizatos ..... A61F 5/05841 128/878
5,692,238 A * 12/1997 Watson, Jr. ..... A41D 20/005 2/102
5,787,505 A * 8/1998 Piwko et al. ..... A41D 13/0051 2/115
6,185,744 B1* 2/2001 Poholski ..... A41D 13/0058 2/102
6,185,750 B1* 2/2001 Dumas ..... A41D 13/0055 2/171.2
6,189,149 B1* 2/2001 Allen ..... A41D 13/0055 2/102
6,438,755 B1* 8/2002 MacDonald et al. ..... A41D 13/0015 2/69
7,533,424 B2* 5/2009 Symonds-Powell ... A41B 11/00 2/239
7,669,252 B2* 3/2010 Wei ..... A41B 11/08 2/239
8,220,074 B2* 7/2012 Sutker ..... A41D 13/0058 2/69
D730,642 S * 6/2015 Boudreau ..... D2/980
D783,265 S * 4/2017 Boudreau ..... D2/980
2008/0078008 A1* 4/2008 Demarest et al. ..... A41D 7/00 2/115
2010/0125931 A1* 5/2010 Arakelian ..... A41D 13/0051 2/207
2011/0214222 A1* 9/2011 Knight et al. ..... A41D 23/00 2/207
2013/0061370 A1* 3/2013 Ezell ..... A41D 23/00 2/207
2013/0227761 A1* 9/2013 Hoskins ..... A41D 23/00 2/207
2014/0026292 A1* 1/2014 Wosu ..... A41D 23/00 2/207
2014/0366237 A1* 12/2014 Boudreau ..... A41B 11/004 2/69
2020/0397072 A1* 12/2020 Arnold et al. ..... A41D 13/0053

* cited by examiner

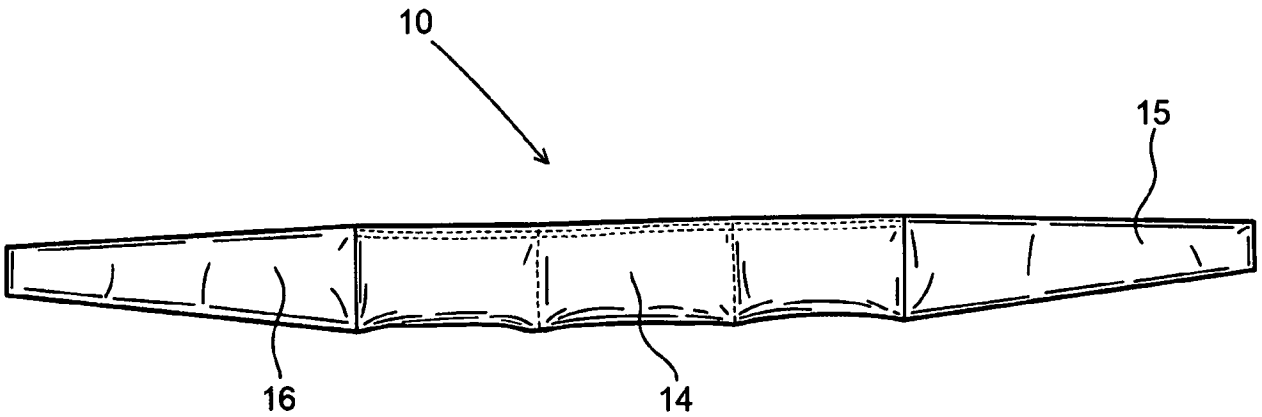
PRIOR ART Fig. 1
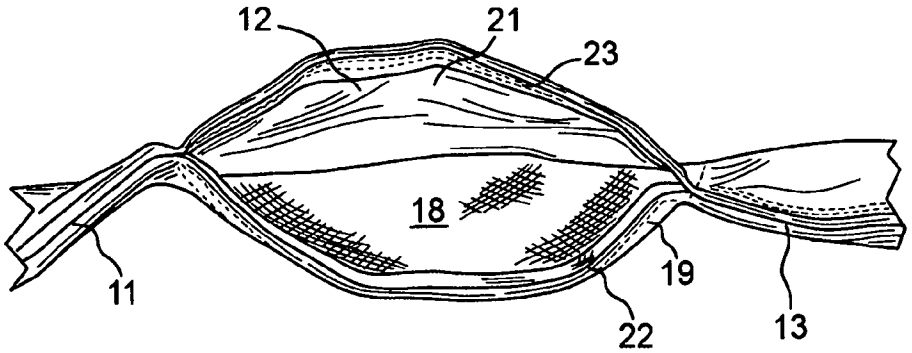
PRIOR ART Fig. 2

BODY COOLING SCARF

A - Body Cooling Scarf - F - 1

BACKGROUND OF THE INVENTION

1. Field of the Invention

The present invention relates generally to the field of body cooling garments. More specifically the present invention relates to a cooling scarf. The cooling scarf includes a flexible tube having a tube side wall and a tube open end with a closure fastener and a tube closed end, defining an elongate tube internal chamber, the tube internal chamber being divided by a flexible, longitudinal, chamber partition into longitudinal first and second cooling unit pockets. A number of cooling units are provided in the form of either cooling packs such as jell cold packs or ice cubes, which are sized in width and breadth to substantially match the width and breadth of a given pocket interior, and sized in length so that a series of such cooling units are required to completely fill a given pocket. The substantially matching widths and breadths of the cooling units and pocket interiors assures that the cooling units cannot slide laterally adjacent to each other within a pocket and thereby pile up at one end of the tube, but instead must remain in a curvilinear or rectilinear array. The large number of cooling units along the length of each pocket makes the scarf highly flexible, and thus capable of more closely following and abutting the curves of the user neck, shoulders and chest for maximized heat transfer. The closure fastener preferably is a zipper extending across the tube open end the full width of the tube open end and generally perpendicular to the partition. A cover flap fastened to the tube side wall preferably wraps over and around the tube open end to cover the zipper when the zipper is closed. The flexible tube and the chamber partition preferably are formed of fabric, and the preferred fabric is brush tricot polyester spandex mix. It is preferred that two different textures of this fabric, an outward fabric strip and an inward fabric strip which is more plush for comfortably resting against the wearer neck and chest.

2. Description of the Prior Art

There previously have been garments of various sorts for cooling different parts of the human body. A prior cooling garment is disclosed in Ezell, U.S. Pat. Application Publication No. 2013/0061370, published on Mar. 14, 2013, for a Neck Scarf for Cooling or Warming the User. Ezell includes a tubular towel having an internal passageway which is collapsed at two spaced apart points where it is sewn together along stitched lines extending across its width, defining three discrete cooling pack chambers. An elongate flap referred to as an end closure section extends from each tube end and includes hook and loop fastener strips. Each chamber receives one cooling pack sized to substantially fill the chamber. See Prior Art FIGS. 1-2. Each chamber has a longitudinal side opening bordered by opposing hook and loop fastener strips, which are closed following insertion of a cooling pack. Then the middle chamber is positioned to rest against the back of a user neck, and the two end chambers are extended forwardly over the user shoulders to rest on the shoulders and upper area the user chest. The end closure sections are releasably fastened together to hold the device in place on the user. A problem with this scarf is its limited flexibility, resulting from its ability to pivot only at the two stitched lines. This lack of significant flexibility causes much of the device to be spaced away from the user skin so that heat transfer and resultant cooling is minimized. In addition, the converged scarf areas surrounding stitched lines are also spaced apart from the user skin, causing gaps in heat transfer between chambers.

It is thus an object of the present invention to provide a body cooling scarf which has a continuous longitudinal chamber, which in turn preferably contains a series of at least six to fourteen cooling units in each parallel pocket, and preferably contains a series of four to fourteen cooling units for a children's size. This number gives the scarf sufficient flexibility and a resulting ability to conform to and abut user skin for maximized heat transfer.

It is another object of the present invention to provide such a scarf which has a continuous chamber extending its full length without any lateral stitched lines between cooling units so that there are no crimped portions and therefore no heat transfer gaps between cooling units.

It is still another object of the present invention to provide such a scarf which has a longitudinal internal partition dividing the chamber into adjacent longitudinal first and second pockets, where the partition preferably extends substantially diametrically.

It is yet another object of the present invention to provide such a scarf with cooling elements sized in width and breadth to substantially match the interior width and breadth of each pocket, so that the cooling units cannot slide laterally adjacent to each other and thus pile up at a scarf end, but are constrained to stay in rectilinear or curvilinear sequence.

It is a still further object of the present invention that corresponding cooling units in the two pockets be directly adjacent to each other so that the scarf can bend at common, adjacent points of abutment.

It is finally an object of the present invention to provide such a scarf which is easy to use and relatively inexpensive to manufacture.

SUMMARY OF THE INVENTION

The present invention accomplishes the above-stated objectives, as well as others, as may be determined by a fair reading and interpretation of the entire specification.

A body cooling scarf is provided, including a flexible retaining tube having a tube side wall and a tube open end and a tube closed end, defining within the retaining tube an elongate tube internal chamber; and a flexible, chamber partition extending longitudinally within and dividing the tube internal chamber into a longitudinal first cooling unit pocket and a second cooling unit pocket.

A body cooling scarf is further provided, including a flexible tube having a tube side wall and a tube open end and a tube closed end, defining within the flexible tube a longitudinal cooling unit pocket having a pocket interior with a pocket interior width, breadth and length; and a series of cooling units which are sized in width and breadth to substantially match the width and breadth of the cooling unit pocket interior, and sized in length such that a series of cooling units, preferably from six to fourteen cooling units in each parallel pocket, and preferably from four to fourteen cooling units for a children's size, to completely fill the pocket, for substantial cooling scarf flexibility. The scarf preferably has a minimum width of three inches and a maximum width of six inches for adults, and two inches for children. The minimum length of the scarf and series of cooling units is preferably twelve inches.

A body cooling scarf is still further provided, including a flexible tube having a tube side wall and a tube open end and a tube closed end, defining within the flexible tube an elongate tube internal chamber; a flexible, chamber partition extending longitudinally within and dividing the tube internal chamber into a longitudinal first cooling unit pocket and a second cooling unit pocket, each having a pocket interior with a pocket interior width, breadth and length; and a series of cooling units which are sized in width and breadth to substantially match the width and breadth of each cooling unit pocket interior, and cooling units are required to completely fill a given pocket, for substantial cooling scarf flexibility.

The cooling scarf preferably additionally includes a closure fastener for closing the tube open end. The flexible tube and partition preferably are formed of fabric. The chamber partition preferably extends substantially diametrically across the internal chamber, so that the first and second cooling unit pockets are of equal with and breadth and length. The cooling units preferably are one of cooling packs and ice cubes. The closure fastener preferably a zipper extending across the tube open end substantially the full width of the flexible retaining tube and generally perpendicular to the partition.

The cooling scarf preferably additionally includes a cover flap secured to the tube side wall adjacent to the tube open end and pivotable across the tube open end to cover the closure fastener. The cooling scarf preferably additionally includes a flap fastener for releasably securing the cover flap in a position covering the closure fastener. The cover flap preferably forms a cuff that can be turned inside out to releasably secure the cover flap over the closure fastener. The flexible tube, the partition, and the cover flap preferably are formed of fabric.

BRIEF DESCRIPTION OF THE DRAWINGS

Various other objects, advantages, and features of the invention will become apparent to those skilled in the art from the following discussion taken in conjunction with the following drawings, in which:

Prior Art FIG. 1 is a front view of the neck scarf of the Ezell reference, shown laid flat.

Prior Art FIG. 2 is a broken away view of side view of one of the Ezell pockets opened to receive a cooling unit.

DETAILED DESCRIPTION OF THE PREFERRED EMBODIMENTS

Figure 3:
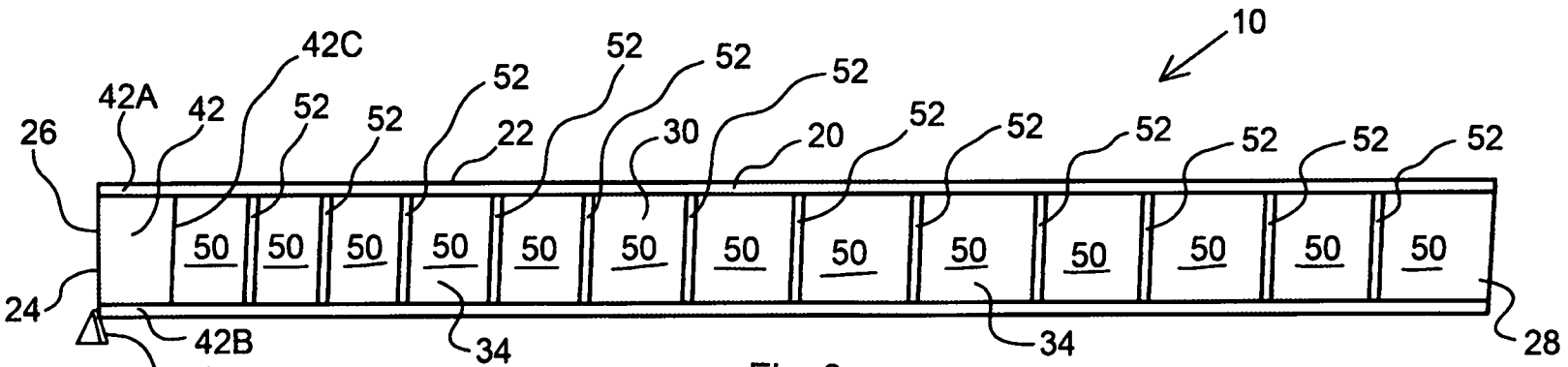
FIG. 3 is a cross-sectional front view of the present body cooling scarf laid flat and filled with a series of cooling units, with the cover flap opened.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiments

Figure 4:
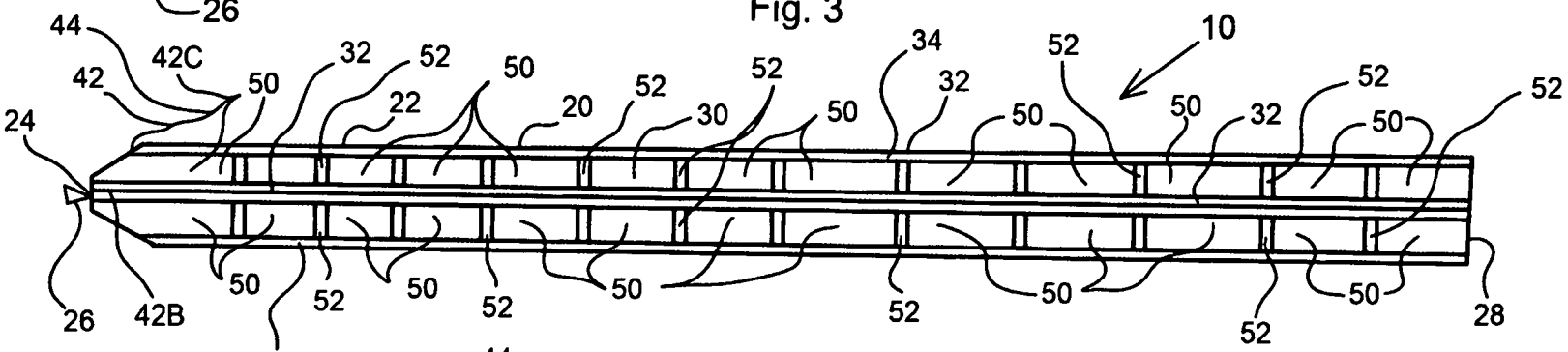
FIG. 4 is a cross-sectional side view of the scarf of FIG. 3, showing in edge view the chamber partition and a series of cooling units above and a series of cooling units below the partition, and again with the cover flap opened.
Figure 5:
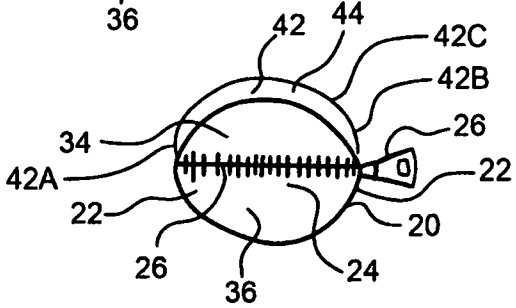
FIG. 5 is an end view of the tube open end with the cover flap opened and the closure fastener in the form of a zipper closed.
Figure 6:
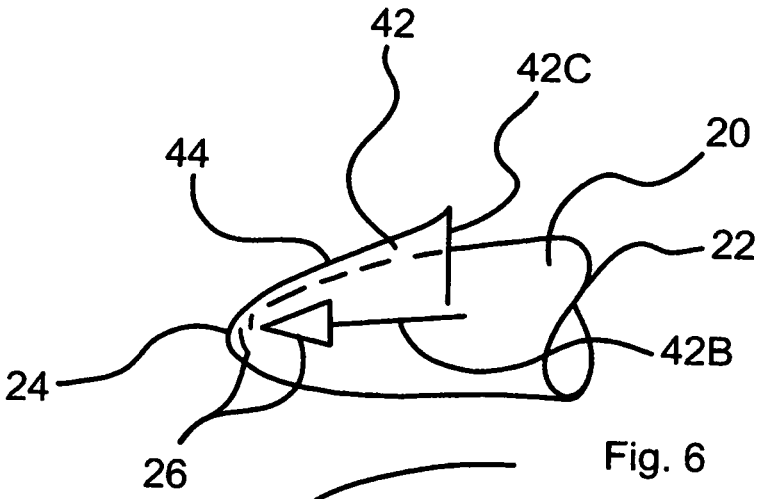
FIG. 6 is a broken away side view of the tube open end showing the cover flap in its undeployed configuration and the open end exposed so that the zipper can be operated.
Figure 7:
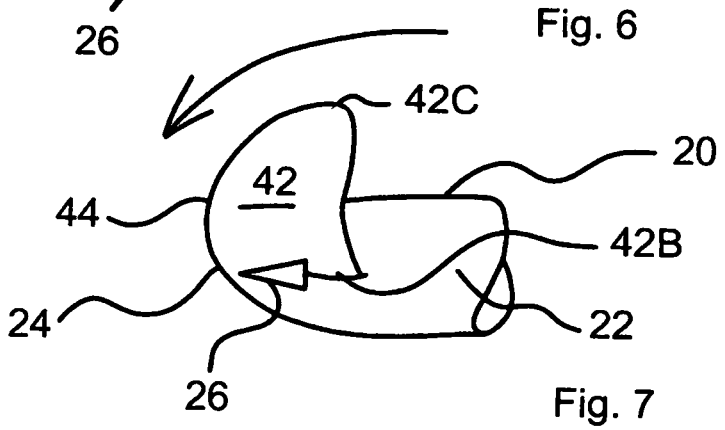
FIG. 7 is a view as in FIG. 6, showing the flap pocket partly turned inside-out and the over flap pivoted toward a zipper covering configuration.
Figure 8:
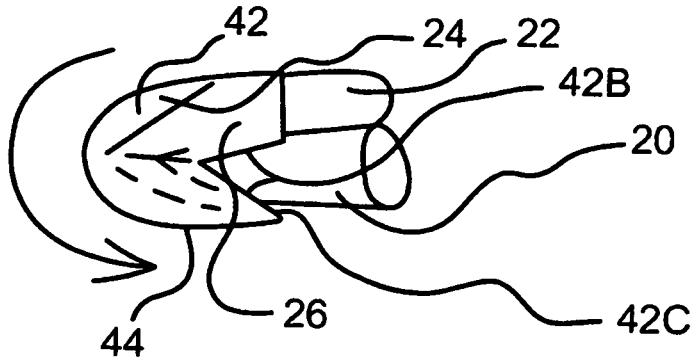
FIG. 8 is a view as in FIGS. 6 and 7, showing the flap pocket turned complete inside-out and the cover flap fully wrapped over the tube open end, covering the zipper.
Figure 9:
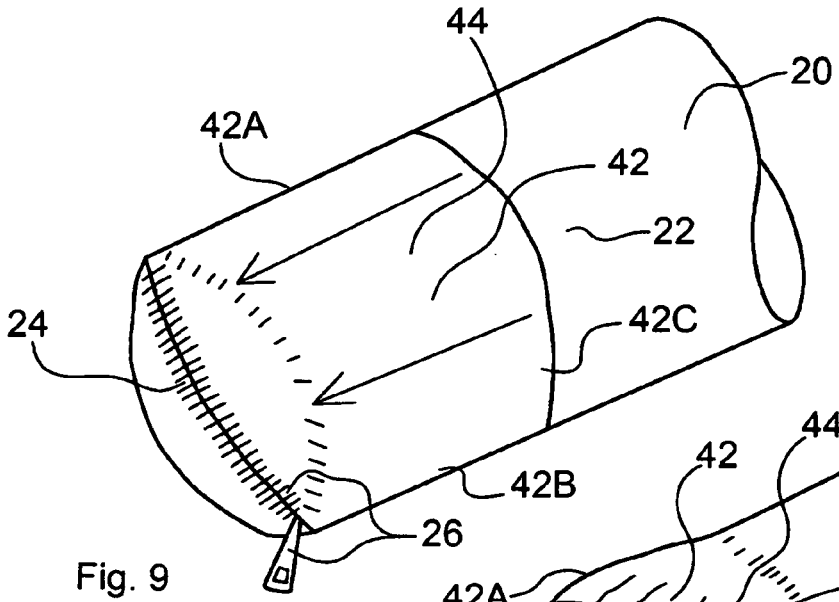
FIG. 9 is a broken away, upper perspective view, once again showing the cover flap in its undeployed position and the open end exposed so that the zipper can be operated.
Figure 10:
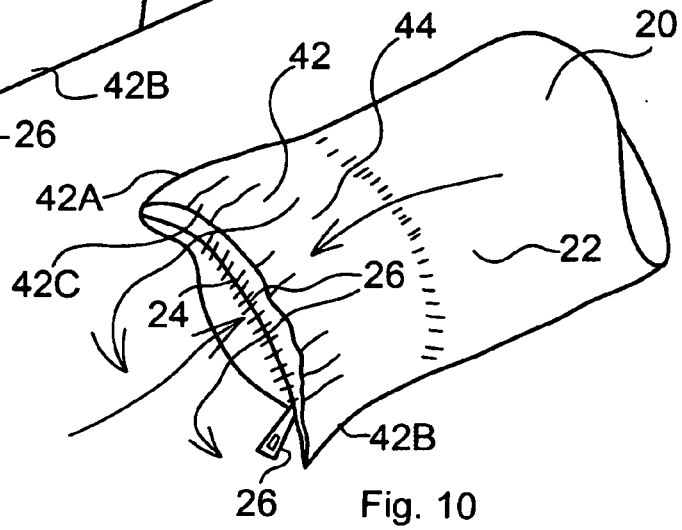
FIG. 10 is a view as in FIG. 9, showing the flap pocket formed by the cover flap partly pulled inside-out and pivoted toward a zipper covering position.
Figure 11:
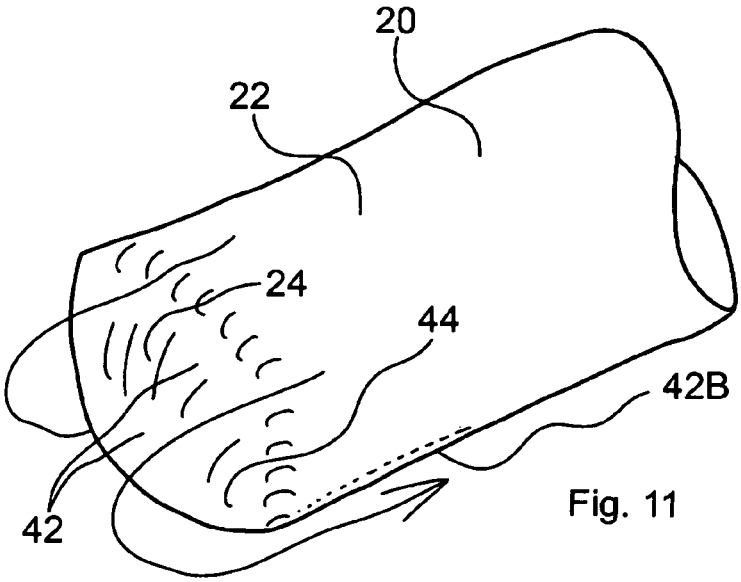
FIG. 11 is a view as in FIGS. 9 and 10, showing the flap pocket turned completely inside-out, so that the cover flap is fully wrapped over the tube open end, covering the zipper.

Referring to FIGS. 3-11, a body cooling scarf 10 is disclosed including a flexible retaining tube 20 having a tube side wall 22 and a tube open end 24 with a closure fastener 26 and a tube closed end 28, defining a linear tube internal chamber 30. The tube internal chamber 30 preferably is divided by a flexible, diametric, longitudinal chamber partition 32 into a longitudinal first cooling unit pocket 34 and a longitudinal second cooling unit pocket 36. A number of cooling units 50 are provided in the form of either cooling packs such as jell cold packs, or ice cubes, which are sized in width and breadth to substantially match the width and breadth of a unit pocket 34 or 36 interior, and sized in length such that a series of cooling units 50 are required to completely fill a given pocket 34 or 36. The substantially matching widths and breadths of the cooling units 50 and pocket 34 or 36 interior assures that these units 50 cannot slide laterally adjacent to each other within a pocket and thereby pile up at the end of the retaining tube 20, but instead must remain in a rectilinear or curvilinear series. It is preferred that the cooling units 50 be interconnected end to end in series by pivoting connecting structures 52 which preferably are formed of a flexible plastic. The substantial number of cooling units 50, and each pocket 34 and 36 preferably contains along its length a series of at least six to fourteen cooling units in each parallel pocket 34 and 36, and preferably contains a series of four to fourteen cooling units 50 for a children's size. It is contemplated that cooling units 50 fill both pockets 34 and 36, or just fill one pocket 34 or 36. This makes the scarf 10 highly flexible, and thus capable of closely following and abutting user skin along the curves and contours of the user neck, shoulders and chest for maximized heat transfer from the user body into the cooling units 50. Another embodiment is contemplated which omits chamber partition 32, and for which cooling units 50 are sized in breadth and width to fit closely into the full interior breadth and width of the interior of retaining tube 20.

The closure fastener 26 preferably is a zipper 26 extending across the tube open end 24 the full width of the flexible retaining tube 20 and generally perpendicular to the chamber partition 32. A cover flap 42 preferably is fastened to the tube side wall 22 adjacent to the tube open end 24, and flap 42 is sewn or otherwise connected along tube open end 24 and connected along opposing flap sides 42A and 42B such as by stitching, so that only the flap free end 42C opposite open end 24 is not connected, so that half cuff in the form of a flap pocket 44 is formed. Cover flap 42 is pivoted to wrap over and around the tube open end 24 to cover zipper 26 when zipper 26 is closed by pulling flap free end 42C toward tube open end 42 and essentially turning the flap pocket 44 inside out around and over the tube open end 24. See FIGS. 6-11. Retaining tube 20, partition 32, and closure flap 42 are all preferably are formed of fabric, and the preferred fabric is brush tricot polyester spandex mix. It is preferred that two different textures of this fabric, an outward fabric strip and an inward fabric strip which is more plush for comfortably resting against the wearer neck and chest.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A body cooling scarf, comprising:

a scarf body comprising a flexible retaining tube having a first tube wall portion and an opposed second tube wall portion extending the length of the flexible retaining tube, a tube side wall, a tube open end, a tube closed end, and an elongate tube internal chamber defined within said flexible tube and having a tube internal chamber width and a tube internal chamber length, wherein the length of the flexible retaining tube extends lengthwise along the scarf body;

a chamber partition comprising a flexible sheet having a first longitudinal sheet edge and a second longitudinal sheet edge; wherein the first longitudinal sheet edge and the second longitudinal sheet edge of the flexible sheet extend within the elongate tube internal chamber between the first tube wall portion and the opposed second tube wall portion, wherein the flexible sheet extends both laterally across said tube internal chamber width and longitudinally along the entire said tube internal chamber length thereby dividing said tube internal chamber into a first cooling unit pocket and a second cooling unit pocket, said first cooling unit pocket extending the length of said flexible retaining tube, said first cooling unit pocket having a first cooling unit pocket interior with a first cooling unit pocket interior width, breadth and length and the second cooling unit pocket extending the length of said flexible retaining tube and along and adjacent to said first cooling unit pocket, said second cooling unit pocket having a second cooling unit pocket interior with a second cooling unit pocket interior width, breadth and length;

a series of first cooling units which are sized in width and breadth to fit into said first cooling unit pocket interior, and are sized in length such that a series of at least four said first cooling units are required to completely fill said first cooling unit pocket of the scarf body; and a series of second cooling units which are sized in width and breadth to fit into said second cooling unit pocket interior, and are sized in length such that a series of at least four of said second cooling units are required to completely fill said second cooling unit pocket of the scarf body.

2. The cooling scarf of claim 1, additionally comprising a closure fastener for closing said tube open end.

3. The cooling scarf of claim 2, wherein said closure fastener comprises a zipper extending across said tube open end substantially the full width of said flexible retaining tube and generally perpendicular to said partition.

4. The cooling scarf of claim 2, additionally comprising a cover flap secured to said tube side wall adjacent to said tube open end and pivotable across said tube open I end to cover said closure fastener.

5. The cooling scarf of claim 4, wherein said cover flap forms a cuff that can be turned inside out to releasably secure the cover flap over the closure fastener.

6. The cooling scarf of claim 4, wherein said flexible tube, said partition, and said cover flap are formed of fabric.

7. The cooling scarf of claim 1, wherein said cooling units are sized in width and breadth to substantially match the width and breadth of each cooling unit pocket interior.

8. The cooling scarf of claim 1, wherein said flexible tube and said flexible sheet are formed of fabric.

9. The cooling scarf of claim 8, wherein the fabric is brush tricot polyester spandex mix.

10. The cooling scarf of claim 1, wherein adjacent said cooling units in each series are interconnected by pivoting connecting structures.

11. The cooling scarf of claim 1, wherein said chamber partition extends substantially diametrically across said internal chamber, such that said first and second cooling unit pockets are of equal width and breadth and length.

12. The cooling scarf of claim 1, wherein said cooling units are one of cooling packs and ice cubes.

* * * * *